US005689842A

United States Patent [19]

Delaney et al.

[11] Patent Number: 5,689,842

[45] Date of Patent: Nov. 25, 1997

[54] BOWL GLOW SYSTEM

[76] Inventors: Michael A. Delaney; Jeffries Arnez Jones, both of 7062 Hanover Pkwy. Apt. 2C, Greenbelt, Md. 20770

[21] Appl. No.: 720,047

[22] Filed: Sep. 27, 1996

[51] Int. Cl.[6] ..... E03D 11/02

[52] U.S. Cl. ..... 4/661; 4/420; 250/462.1

[58] Field of Search ..... 4/661, 234, 237, 4/242.1, 420, DIG. 6; 250/462.1, 463.1, 466.1

[56] References Cited

U.S. PATENT DOCUMENTS

| | | | |
|---|---|---|---|
| 2,387,512 | 10/1945 | Hilberg | 250/462.1 |
| 3,486,172 | 12/1969 | Gleichert | 4/300.3 |
| 5,003,648 | 4/1991 | Anderson | 4/661 |
| 5,123,130 | 6/1992 | Sanders | 4/902 |
| 5,263,209 | 11/1993 | Pattee | 4/661 |
| 5,307,524 | 5/1994 | Veal | 4/246.1 |
| 5,373,589 | 12/1994 | Rego et al. | 4/300.3 |

*Primary Examiner*—Henry J. Recla
*Assistant Examiner*—Charles R. Eloshway

[57] ABSTRACT

A new Bowl Glow System for providing toilet illumination by way of a phosphorescent member affixed to a toilet bowl rim. The device includes a phosphorescent member affixed to a toilet bowl rim.

6 Claims, 3 Drawing Sheets

BOWL GLOW SYSTEM

BACKGROUND OF THE INVENTION

1. Field of the Invention

The present invention relates to toilet illumination devices and more particularly pertains to a new Bowl Glow System for providing toilet illumination by means of a phosphorescent member affixed to a toilet bowl rim.

2. Description of the Prior Art

The use of toilet illumination devices is known in the prior art. More specifically, toilet illumination devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art toilet illumination devices include U.S. Pat. No. 3,982,288; U.S. Pat. No. 5,263,209; U.S. Pat. No. 5,437,066; and U.S. Pat. No. 5,003,648.

While these devices fulfill their respective, particular objectives and requirements, the aforementioned patents do not disclose a new Bowl Glow System. The inventive device includes a phosphorescent member and a means for affixing the phosphorescent member to a toilet bowl rim.

In these respects, the Bowl Glow System according to the present invention substantially departs from the conventional concepts and designs of the prior art, and in so doing provides an apparatus primarily developed for the purpose of providing toilet illumination by means of a phosphorescent member affixed to a toilet bowl rim.

SUMMARY OF THE INVENTION

In view of the foregoing disadvantages inherent in the known types of toilet illumination devices now present in the prior art, the present invention provides a new Bowl Glow System construction wherein the same can be utilized for providing toilet illumination by means of a phosphorescent member affixed to a toilet bowl rim.

The general purpose of the present invention, which will be described subsequently in greater detail, is to provide a new Bowl Glow System apparatus and method which has many of the advantages of the toilet illumination devices mentioned heretofore and many novel features that result in a new Bowl Glow System which is not anticipated, rendered obvious, suggested, or even implied by any of the prior art toilet illumination devices, either alone or in any combination thereof.

To attain this, the present invention generally comprises a phosphorescent member and a means for affixing the phosphorescent member to a toilet bowl rim.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

it is therefore an object of the present invention to provide a new Bowl Glow System apparatus and method which has many of the advantages of the toilet illumination devices mentioned heretofore and many novel features that result in a new Bowl Glow System which is not anticipated, rendered obvious, suggested, or even implied by any of the prior art toilet illumination devices, either alone or in any combination thereof.

It is another object of the present invention to provide a new Bowl Glow System which may be easily and efficiently manufactured and marketed.

it is a further object of the present invention to provide a new Bowl Glow System which is of a durable and reliable construction.

An even further object of the present invention is to provide a new Bowl Glow System which is susceptible of a low cost of manufacture with regard to both materials and labor, and which accordingly is then susceptible of low prices of sale to the consuming public, thereby making such Bowl Glow System economically available to the buying public.

Still yet another object of the present invention is to provide a new Bowl Glow System which provides in the apparatuses and methods of the prior art some of the advantages thereof, while simultaneously overcoming some of the disadvantages normally associated therewith.

Still another object of the present invention is to provide a new Bowl Glow System for providing toilet illumination by means of a phosphorescent member affixed to a toilet bowl rim.

Yet another object of the present invention is to provide a new Bowl Glow System which includes a phosphorescent member and a means for affixing the phosphorescent member to a toilet bowl rim.

Still yet another object of the present invention is to provide a new Bowl Glow System that makes finding the toilet at night, when a person's eyes are dark-adapted, easy thereby sparing the person the effects of a sudden change in light intensity.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
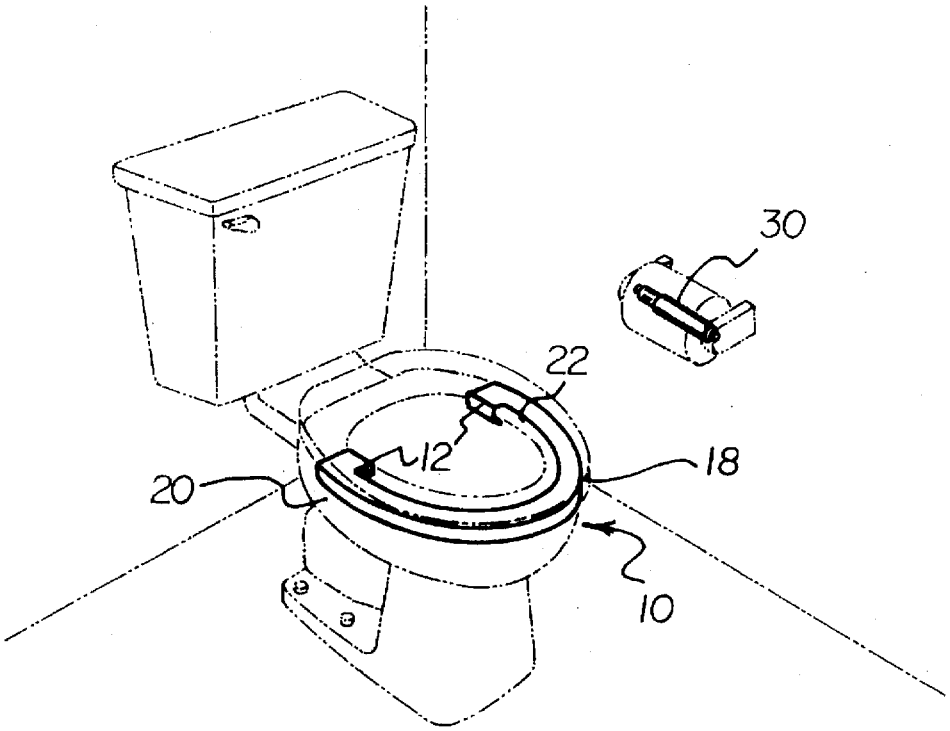
FIG. 1 is a right side perspective view of a new Bowl Glow System according to the present invention.

With reference now to the drawings, and in particular to FIGS. 1 through 6 thereof, a new Bowl Glow System embodying the principles and concepts of the present invention and generally designated by the reference numeral 10 will be described.

More specifically, it will be noted that the Bowl Glow System 10 comprises a phosphorescent member and a means for affixing the phosphorescent member to a toilet bowl rim.

With reference to FIG. 1 the Bowl Glow System 10 of the present invention is shown. The phosphorescent member 18 is disposed upon the toilet bowl rim 22 of toilet bowl 20. Means for affixing the phosphorescent member 18 to the toilet bowl rim 22 are indicated by the reference number 12. Also shown in FIG. 1 is a phosphorescent toilet paper holder 30.

Figure 2:
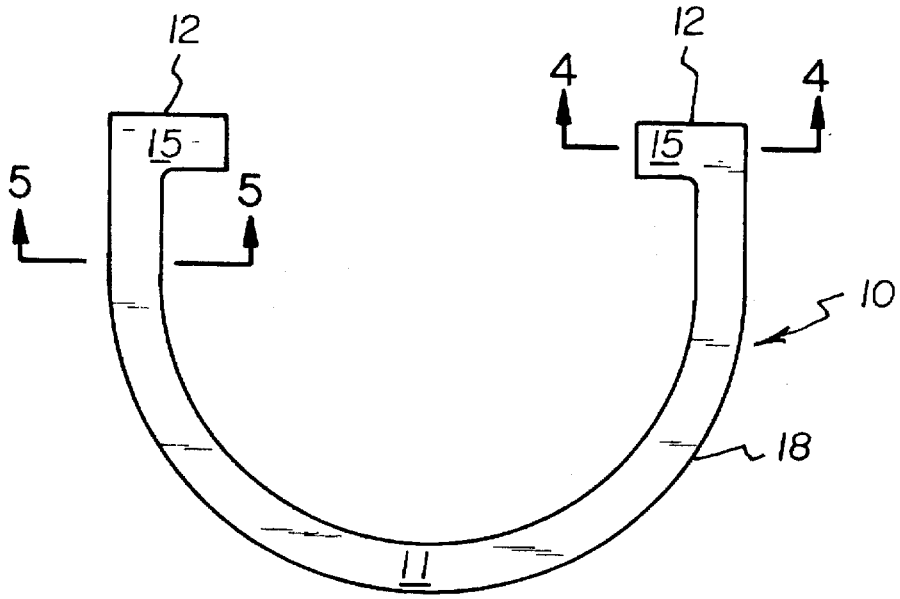
FIG. 2 is a top plan view thereof.

FIG. 2 shows the means for affixing the phosphorescent member 12 to the toilet bowl rim disposed at first and second ends 15 of the phosphorescent member 18.

Figure 3:
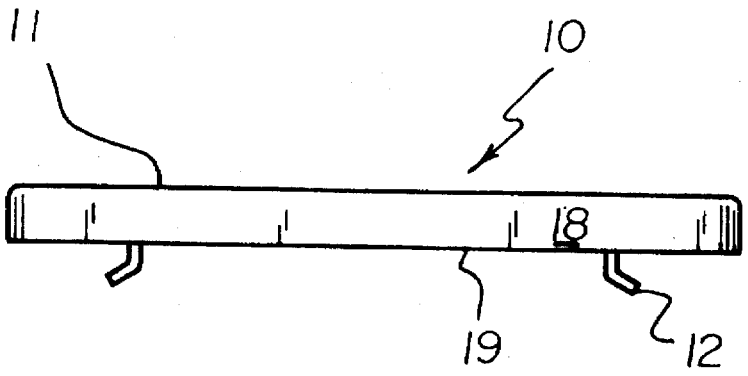
FIG. 3 is a front view of the present invention.

With reference to FIG. 3 phosphorescent member 18 includes an upper surface 11 and a lower surface 19. Lower surface 19 rests upon the toilet bowl rim 22. Means for affixing the phosphorescent member 12 are shown extending beyond the plane of the phosphorescent member 18.

Figure 4:
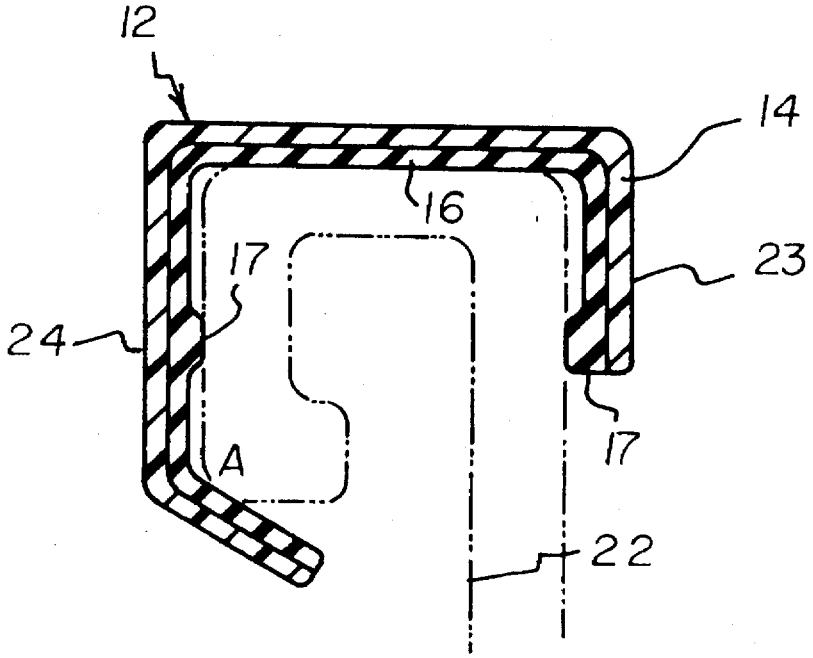
FIG. 4 is a cross sectional view of the invention taken along line 4—4 of FIG. 2.
Figure 5:
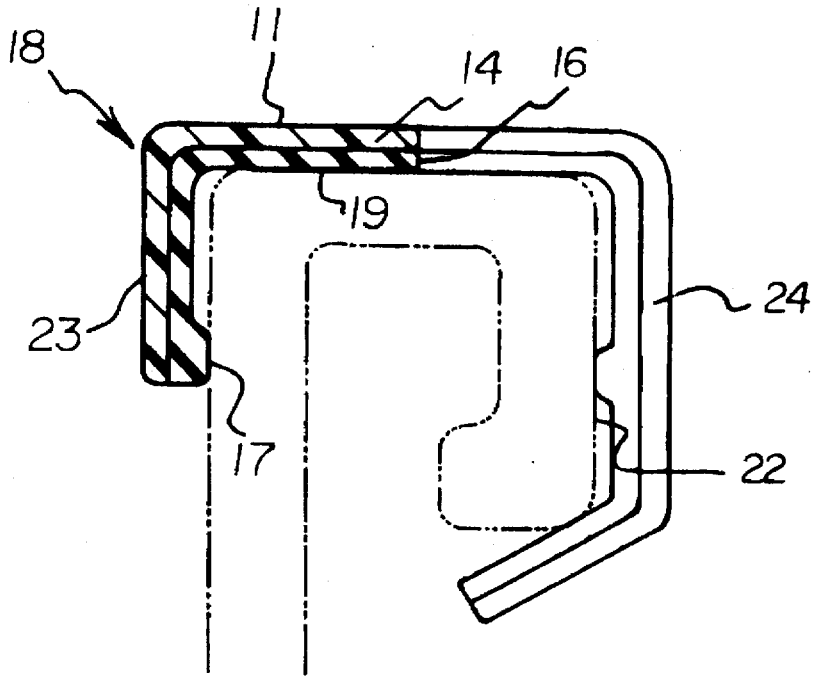
FIG. 5 is a cross sectional view taken along line 5—5 of FIG. 2.

FIG. 4 shows the means for affixing the phosphorescent member 12 including integral opposing flanges 23 and 24. Inside flange 24 is formed so as to be in frictional contact at point A of the toilet bowl rim 22. Outside flange 23 extends around the periphery of phosphorescent member 18 (FIG. 5) and is in frictional contact with the outside of the toilet bowl 20. Phosphorescent member 18 includes a phosphorescent layer 14 and a rubber layer 16 that provides additional friction between the phosphorescent member 18 and the toilet bowl rim 22. Opposing protrusions 17 are provided on the flanges 23 and 24 to make the Bowl Glow System adaptable to different style toilet bowls.

Figure 6:
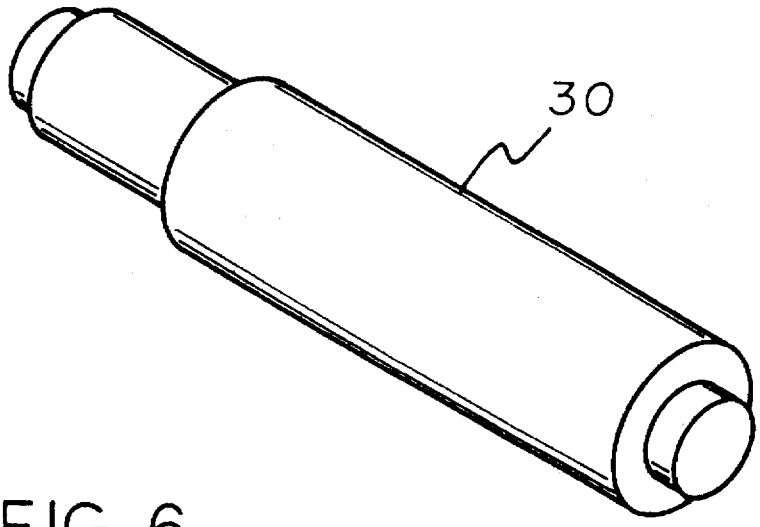
FIG. 6 is a perspective view of a toilet paper holder.

FIG. 6 shows the phosphorescent toilet paper holder 30 of the present invention.

In use, the Bowl Glow System is affixed to the rim of a toilet bowl by engaging the means for attaching the phosphorescent member 12 to the rim 22. Once in place the Bowl Glow System will glow and provide a person needing to use the toilet in the dark a way of finding the toilet without having to turn on any lights.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Bowl Glow System comprising:

a phosphorescent member comprising a substantially flat rim portion having a substantially arcuate shape adapted for resting on the upper surface of a toilet bowl rim, said rim portion having an inside edge for orienting toward the interior of the toilet bowl and an outside edge for orienting away from the interior of the toilet bowl, said rim portion also having first and second ends for positioning on the upper surface of the toilet bowl rim; and affixing means for affixing the phosphorescent member to a toilet bowl rim, said affixing means including a pair of discrete inner flanges, each of said pair of discrete inner flanges being connected to said inner edge of said rim portion at one of said first and second ends, and a continuous outer flange extending along the entire outer edge of said rim portion, thereby permitting said flanges to embrace a portion of said toilet bowl rim.

2. The Bowl Glow System of claim 1, wherein each said inner flange includes a protrusion formed thereon and said outer flange has a pair of protrusions formed thereon and located so as to be disposed oppositely of said protrusions on said inner flanges, said protrusions acting to clamp said bowl rim therebetween and secure said phosphorescent member to said bowl rim.

3. The Bowl Glow System of claim 1, additionally comprising a phosphorescent spindle shaft for insertion into a toilet paper holder.

4. The Bowl Glow System of claim 1, wherein the phosphorescent member further comprises an upper layer comprising a phosphorescent material and a lower layer comprising a material for providing friction between the toilet rim and the phosphorescent member.

5. A Bowl Glow System, comprising:

a phosphorescent member; and a means for affixing the phosphorescent member to a toilet bowl rim wherein the phosphorescent member further comprises an upper and a lower surface and the lower surface is adapted to rest upon the toilet bowl rim in use;

wherein the phosphorescent member further comprises first and second ends for positioning at opposite portions of the upper surface of the toilet bowl rim;

wherein the phosphorescent member further comprises an inside surface for orienting toward the inside of the toilet bowl in use, an outside surface for orienting toward the outside of the toilet bowl in use, and wherein the means for affixing the phosphorescent member to the toilet bowl rim comprises a pair of opposing flanges located at each of the first and second ends of the phosphorescent member, wherein one said flange of a said pair depends from the inside surface and the other said flange of a said pair depends from the outside surface;

wherein the phosphorescent member further includes an upper layer comprising a phosphorescent material and a lower layer comprising a material for providing friction between the toilet rim and the phosphorescent member;

wherein each of the opposing flanges further comprises an inner flange surface adapted to be oriented toward the toilet bowl rim, and protrusions disposed opposite each other on each inner flange surface of opposing flanges to grip said toilet bowl rim.

6. The Bowl Glow System of claim 5, additionally comprising a phosphorescent toilet paper holder.

* * * * *